United States Patent [19]

Drutchas

[11] 4,408,963

[45] Oct. 11, 1983

[54] POWER STEERING PUMP

[75] Inventor: Gilbert H. Drutchas, Birmingham, Mich.

[73] Assignee: TRW Inc., Cleveland, Ohio

[21] Appl. No.: 166,407

[22] Filed: Jul. 7, 1980

[51] Int. Cl.[3] ..... F04B 49/08; F04B 49/02

[52] U.S. Cl. ..... 417/283; 417/310; 418/135

[58] Field of Search ..... 417/310, 308, 307, 283, 417/284, 287, 288, 304, 300, 79; 418/133, 134, 135

[56] References Cited

U.S. PATENT DOCUMENTS

| | | | |
|---|---|---|---|
| 2,759,423 | 8/1956 | Keel | 417/79 |
| 2,809,588 | 10/1957 | Stewart | 103/42 |
| 2,818,813 | 1/1958 | Pettibone et al. | 417/300 |
| 3,578,888 | 5/1971 | Adams | 417/133 |
| 3,713,757 | 1/1973 | Hause | 418/133 |
| 3,822,965 | 7/1974 | Drutchas et al. | 417/53 |
| 3,930,759 | 1/1976 | Drutchas | 417/283 |
| 4,014,630 | 3/1977 | Drutchas | 417/283 |

*Primary Examiner*—William R. Cline
*Assistant Examiner*—John M. Kramer
*Attorney, Agent, or Firm*—Yount & Tarolli

[57] ABSTRACT

A pump has an inlet, an outlet, and a fluid displacement mechanism operable to pump fluid from the inlet to the outlet. A cheek plate in the pump is movable to control a flow of fluid from the outlet back to the inlet and thereby to vary the fluid flow to a hydraulic system supplied by the pump. Acting on different and unequal surface areas of the cheek plate are two fluid pressure forces. One fluid pressure force is provided by fluid pressure in a cheek plate control chamber. The force acts with a spring biasing force to bias the cheek plate into a position blocking the flow of fluid from the outlet back to the inlet. The second fluid pressure force acts on the cheek plate against the spring force and the first fluid pressure force. A first orifice communicates the pump outlet with the hydraulic system, a second orifice communicates the system with the control chamber, and a third orifice communicates the control chamber with the pump inlet. The second and third orifices are sized relative to each other to provide, at a predetermined rate of flow to the system, a fluid pressure in the control chamber which has a ratio to system pressure generally equal to the ratio of (a) the area of the cheek plate surface on which the second fluid pressure force acts to (b) the area of the cheek plate surface on which the first fluid pressure force acts.

8 Claims, 6 Drawing Figures

POWER STEERING PUMP

BACKGROUND OF THE INVENTION

The present invention relates generally to pumps, and particularly to power steering pumps for use in vehicle steering systems. Power steering pumps for use in vehicle steering systems are well known and have many different constructions. Normally, such a pump has associated controls for controlling the flow of fluid to a steering system in response to changing pressure demands. The pump also has controls to insure that an excessive amount of fluid flow from the pump is not directed to the steering system.

The present invention specifically relates to a type of power steering pump known as a "cheek plate unloading pump". U.S. Pat. No. 3,822,965 describes and illustrates a pump of this type, which incorporates a movable cheek plate. One side of the cheek plate is presented to the pump displacement mechanism, while the opposite side of the plate faces a fluid pressure chamber. The pressure in the chamber is controlled by a value. The valve is a servo valve that responds to pressure drops in the associated hydraulic system. By controlling the pressure in the chamber, the valve controls the magnitude of forces that act on the cheek plate, and can thereby affect movement of the cheek plate. When the cheek plate moves, fluid is bypassed directly from the outlet of the pump to its inlet, and thus the volume of flow from the pump to an associated hydraulic system is varied. Once a desired and predetermined rate of flow is achieved by a cheek plate unloading pump, the pump maintains the desired flow rate despite variations in pump speed and pressure in an associated hydraulic system.

As noted, the pump of U.S. Pat. No. 3,822,965 uses a servo valve for controlling the flow of fluid from the pump to the associated hydraulic system. The use of a servo valve complicates pump control. The servo valve involves a plurality of parts and is costly. Further, stabilization of the servo valve is necessary. U.S. Pat. No. 4,014,630 discloses a system for stabilizing such a servo valve.

SUMMARY OF THE PRESENT INVENTION

The pump of the present invention is a cheek plate unloading pump that does not require a servo valve for controlling a fluid pressure that acts on the cheek plate. Instead, the pump incorporates a plurality of orifices to control the fluid pressure. The forces that act on the pump's cheek plate include first and second fluid pressure forces. The first fluid pressure force acts on a side or surface of the cheek plate adjacent to the pump displacement mechanism. The second fluid pressure force acts on an opposite side or surface of the cheek plate. The second fluid pressure force is provided by fluid under pressure in a cheek plate control chamber located adjacent the cheek plate. A spring force acts with the second fluid pressure force.

There is continuous fluid communication between the system supplied by the pump and the cheek plate control chamber and between the cheek plate control chamber and the inlet of the pump. Orifices located between (a) the cheek plate control chamber and (b) the system and pump inlet, respectively, control the pressure in the chamber. The orifices are designed so that when the pump achieves a predetermined speed providing a desired flow to the system, the pressure in the control chamber produces a force that, together with the spring force, is balanced by the first fluid pressure force. At speeds above the predetermined speed, the forces become unbalanced and the cheek plate is moved to restore the balance and to maintain the desired rate of fluid flow to the system.

As noted above, the first fluid pressure force acts on the cheek plate against the spring force and the second fluid pressure force. The first fluid pressure force is made up of two components. One component is determined by system pressure. The other component is determined by the pressure drop across an outlet orifice through which fluid from the pump outlet flows to the system. The orifice insures a difference between pump outlet pressure and system pressure.

Each fluid pressure force that acts on the cheek plate is equal to the respective pressure multiplied by the area of the surface against which the pressure acts. The surfaces of the cheek plate against which the first and second fluid pressures act have unequal total areas. To achieve a balance of forces acting on the cheek plate, therefore, the orifices in the pump maintain a relationship between the first and second fluid pressures which is a function of (a) the respective areas against which the pressures act and (b) the need to counteract the spring force. Specifically, the orifices are sized to maintain the ratio of the fluid pressure in the cheek plate control chamber (i.e., the second fluid pressure) to system fluid pressure (i.e., the first fluid pressure less the pressure drop across the outlet orifice) equal to the ratio of (a) the area of the cheek plate surface against which the pump output or first fluid pressure acts to (b) the area of the cheek plate surface against which the fluid pressure in the cheek plate control chamber acts. In this manner, when the pump achieves its predetermined speed and desired output flow, the first fluid pressure force will be sufficiently larger than the second fluid pressure force to balance both the second fluid pressure force and the spring force that acts on the cheek plate.

As output from the pump increases beyond the desired output, due to increases in pump speed, the difference between the first and second fluid pressure forces will exceed the spring force and the cheek plate will move away from the pump's displacement mechanism. Such movement will cause fluid from the outlet to be bypassed to the inlet, thereby maintaining a constant rate of fluid flow to the system. Similarly, above a predetermined system pressure, system pressure increases or decreases will cause the cheek plate to move so as to bypass less or more fluid, respectively. Thus, a substantially constant flow of fluid to the system will be maintained.

DESCRIPTION OF THE FIGURES

Further features and advantages of the present invention will become apparent to those skilled in the art to which it relates upon consideration of the following description of a preferred embodiment of the invention, which description is made with reference to the accompanying drawings, in which.

DESCRIPTION OF A PREFERRED EMBODIMENT

Figure 1:
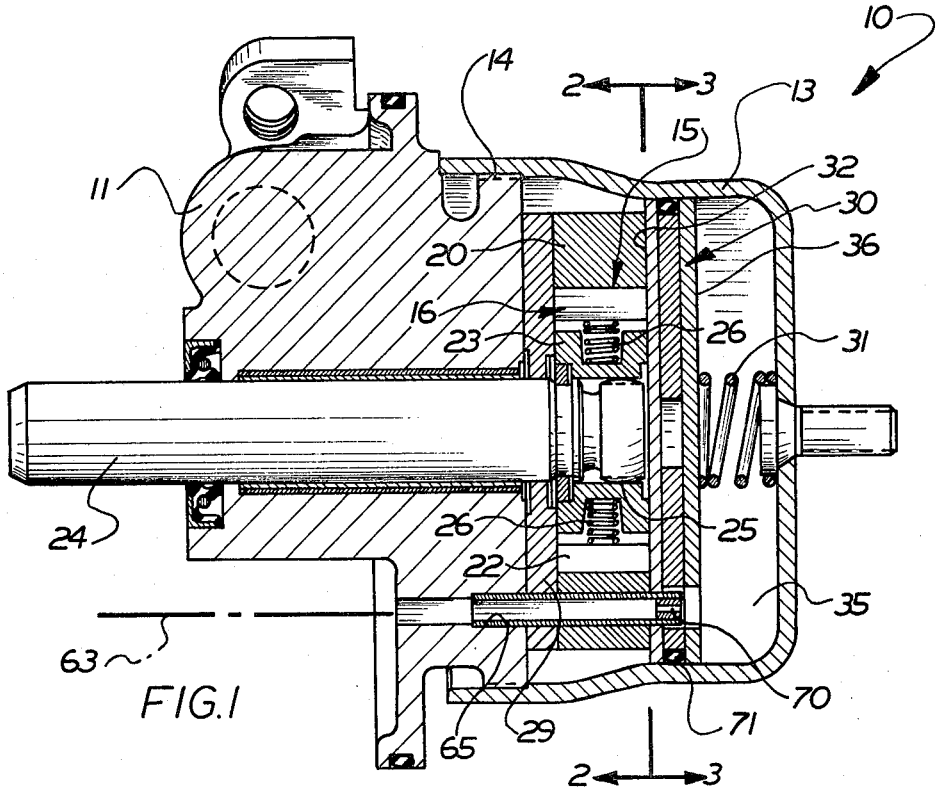
FIG. 1 is a sectional view of a pump embodying the present invention.

The present invention is preferably embodied in a power steering pump 10. The power steering pump 10 includes a housing member 11 that incorporates a pump inlet and a pump outlet (not shown) and an outer shell 13 that is threadedly engaged with the housing member, as at 14. The housing member 11 and the shell 13 together define, in part, a pumping chamber 15 in which is located a displacement mechanism 16 for pumping fluid.

Figure 2:
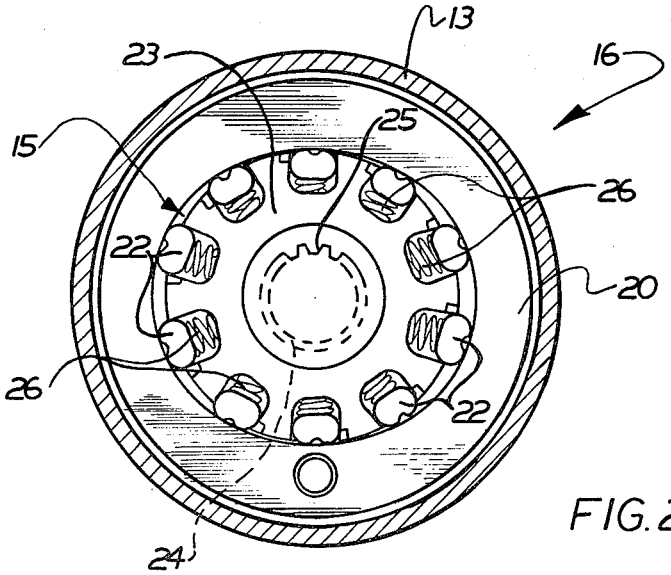
FIG. 2 is a view taken approximately along line 2—2 of FIG. 1.

The pump displacement mechanism 16 may be of any conventional construction and is shown as including a cam ring 20 (FIG. 2) which is radially located relative to the housing member 11 by dowels or pins (not shown). The cam ring 20 has an internal bore that is slightly oblong in shape and receives an annular rotor 23. The rotor 23 is rotated or driven by an input shaft 24 that has a driving spline connection with the inner circumference of the rotor, such as at 25.

Mounted in slots formed in the outer circumference of the rotor 23 are slippers 22. Each slipper 22 is biased radially outward into engagement with the inner periphery of the cam ring 20 by a spring 26. Adjacent slippers 22 define pumping pockets. As the rotor 23 rotates, the pumping pockets expand and contract due to the configuration of the cam ring bore. Inlet and outlet ports formed in a port plate 29 (FIG. 1) deliver fluid to and receive fluid from the pumping pockets. The relative orientation of the port plate 29 and the cam ring 20 is such that when a pumping pocket is aligned with an inlet port, the pocket is expanding and fluid is drawn into the pocket. When a pocket is aligned with an outlet port, the pocket is contracting and fluid is forced from the pocket.

The pump 10 described above may be referred to as a slipper pump. As the construction of such a pump is known, details of the construction will not be given herein. The pump's cam ring 20 is of a double-lobe construction, and the port plate 29 has two inlet ports and two outlet ports. The inlet and outlet port configurations do not specifically form a part of the present invention and are not shown in the drawings. Further, neither the inlet passages that connect the inlet ports with the pump inlet and the fluid supply nor the complete outlet passages that communicate the outlet ports with the pump outlet are shown, as these passages are conventional and do not form part of the present invention.

The pump 10, like the pumps of U.S. Pat. Nos. 3,822,965 and 4,014,630, may also be described as a cheek plate unloading pump. Specifically, the pump 10 includes a cheek plate 30 that partly defines the pumping chamber 15 in which the pumping action occurs. The cheek plate 30 is preferably made of a plurality of stamped metal members, the details of which will not be described. An O-ring 71 encircles the cheek plate 30 and engages the inner periphery of the outer shell 13. The O-ring 71 maintains a sealing relationship between the cheek plate 30 and the shell 13 to prevent leakage of fluid between the cheek plate and the shell.

The cheek plate 30 is normally biased by a spring 31 toward engagement with the pump displacement mechanism 16. One radially extending side or surface 32 of the cheek plate 30 is thus engageable with radially extending surfaces of the cam ring 20 and the rotor 23. When in such an engaged position, the cheek plate 30 seals or blocks any flow of fluid from the pumping pockets that are communicating with the pump's outlet ports to the pumping pockets that are communicating with the pump's inlet ports. Accordingly, when the cheek plate 30 is in the position shown in FIGS. 1 and 4, there is no bypass of fluid from the outlet ports back to the inlet ports and substantially all of the output of the pump is directed to an open center system supplied by the pump.

Figure 4:
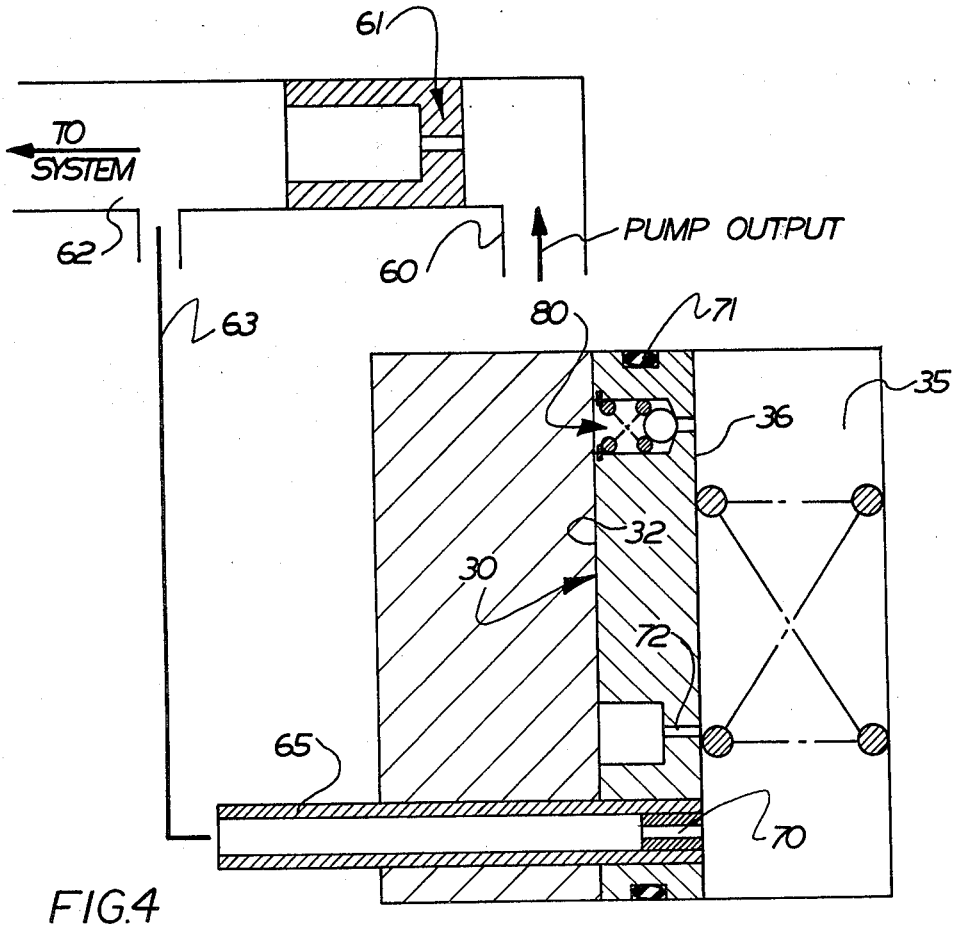
FIG. 4 is a schematic illustration of the flow control system utilized in the pump of FIG. 1 with the cheek plate in a sealing or non-bypassing position.

If the cheek plate 30 is located to the right of the position shown in FIGS. 1 and 4, fluid can flow along the space between the cheek plate and the rotor 23. Such fluid is thus directly communicated from the pump outlet ports to the pump inlet ports across the face 32 of the cheek plate and bypasses the system supplied by the pump. The larger the space between the rotor 23 and the cheek plate 30, the greater the amount of fluid that is bypassed. Accordingly, by accurately controlling the position of the cheek plate 30, the fluid flow to the system can also be controlled.

Figure 3:
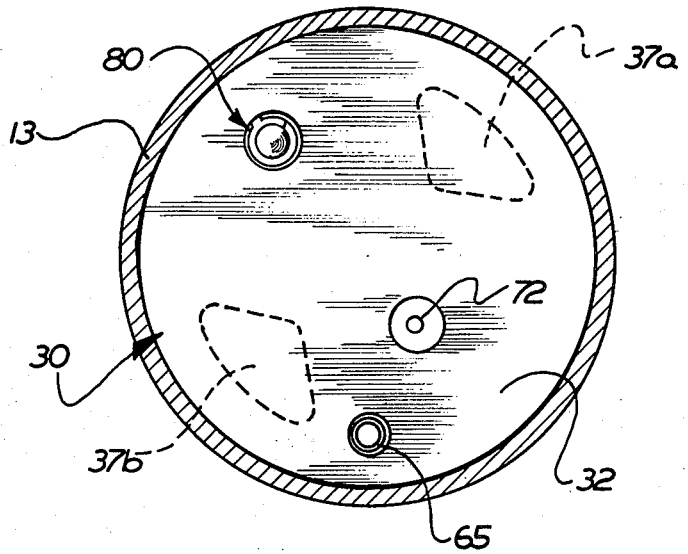
FIG. 3 is a view taken approximately along line 3—3 of FIG. 1.

To help position the cheek plate accurately, the pump 10 includes a cheek plate control chamber 35. The chamber 35 is located on the right side of the cheek plate, as viewed in FIG. 1. Fluid in the chamber 35 exerts pressure on a radially extending side or surface 36 of the cheek plate 30 which is opposite the surface 32. Opposing the force resulting from the fluid pressure in the control chamber 35, as well as the force generated by the spring 31, is a force resulting from the pressure of fluid in the displacement mechanism 16 adjacent the pump's outlet ports. The outlet fluid pressure acts against two portions of the surface 32 which are shown in FIG. 3 enclosed by dashed lines and are designated **37*a*, 37*b*. The remainder of cheek plate surface 32 is acted on by the inlet fluid pressure, which is at or near zero. The sum of the area of the surface portion 37*a* plus the area of the surface portion 37*b* is approximately one-fourth of the area of the surface 36, against all of which the pressure in the cheek plate control chamber 35 acts. The relationship or ratio of the area of surface 36 to the combined area of surface portions 37*a*, 37*b* may vary from pump to pump, depending upon other pump characteristics, as discussed below, but the area of surface 36 will always be substantially larger than the total area of surface portions 37*a*, 37*b***.

Figure 5:
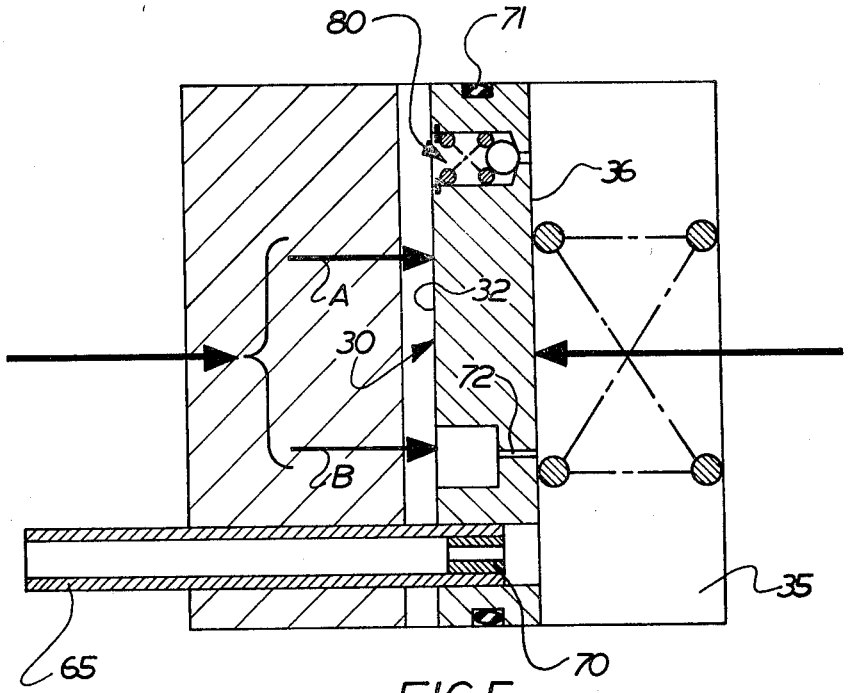
FIG. 5 is a schematic illustration showing the cheek plate of the pump of FIG. 4 in a position where it is bypassing fluid, the distance which the cheek plate moves between the sealing position of FIG. 4 and the bypass position of FIG. 5 being exaggerated for clarity of illustration.

When the cheek plate 30 moves from the sealing or nonbypass position of FIG. 4 to the bypass position of FIG. 5, the pressure along the edges of the surface portions **37*a*, and 37*b* tends to decrease. At the same time, the areas of the surface portions 37*a* and 37*b* tend to increase by expanding outwardly. The net effect of establishing a pressure gradient along the edges of the surface portions 37*a* and 37*b* and expanding the surface area that is exposed to a pressure above inlet pressure is to maintain the effective areas of the surface portions 37*a* and 37*b* substantially constant as the cheek plate 30 moves from the sealing position (FIG. 4**) to the bypass position (FIG. 5). It should be noted that the distance through which the cheek plate moves has been exaggerated in FIG. 5 for clarity of illustration.

Fluid pressure is supplied to the cheek plate control chamber 35 from the pump outlet. Specifically, the pump outlet flow is through a conduit, shown schematically as 60 (FIG. 4), and through a flow control orifice 61. Flow through the orifice 61 is directed to the associated hydraulic system by a conduit 62. The pressure in the conduit 62 is system pressure. The pressure in the conduit 60 is pump outlet pressure. The flow control orifice 61 provides a pressure drop between the pump outlet pressure and system pressure.

A conduit 63 communicates system pressure (pressure in conduit 62) with the chamber 35. Specifically, a hollow dowel pin 65 communicates the fluid pressure through the cheek plate 30 and into the chamber 35. An orifice 70 is located in the flow path between the conduit 62 and the chamber 35. The orifice 70 provides a pressure drop between system pressure and the pressure in the chamber 35. Also, the only fluid flow into the chamber 35 is through the orifice 70.

An orifice 72 in the cheek plate 30 directs a flow of fluid from the chamber 35 to the pump inlet. The orifice 72 is extremely small and provides a very small leakage flow to the inlet. The relative sizes of the orifices 61, 70, and 72 are important to balancing the forces on the cheek plate, and will be described hereinbelow in detail. Orifices 61, 70, 72 are shown schematically in the drawings, and may be constructed in any desired manner.

From the above, it should be apparent that during pump operation, a continuous flow of fluid is provided through the cheek plate control chamber 35 to the pump inlet, and fluid thus continuously flows through orifices 70, 72. The quantity of flow through the orifice 70 is the same as the quantity of flow through the orifice 72. Two equations can be written to cover the flow through the orifices.

The equations are based on Bernoulli's equation, which in its general form is:

$$Q = (C)(A)\sqrt{\Delta P}$$

where,

C=Constant

Q=Flow rate in gallons per minute

A=Orifice area in square inches

ΔP=The pressure drop across an orifice.

Thus, the equations for the flow through orifices 70 and 72 are:

$$Q_{70} = (C)(A_{70})\sqrt{\Delta P_{70}}$$

$$Q_{72} = (C)(A_{72})\sqrt{\Delta P_{72}}$$

Dividing the equations, $$\frac{Q_{70}}{Q_{72}} = \frac{C\,A_{70}}{C\,A_{72}}\;\frac{\sqrt{\Delta P_{70}}}{\sqrt{\Delta P_{72}}} \tag{1}$$

Since the flow through orifice 70 ($Q_{70}$) equals the flow through orifice 72 ($Q_{72}$):

$$1 = \frac{A_{70}}{A_{72}}\;\frac{\sqrt{\Delta P_{70}}}{\sqrt{\Delta P_{72}}} \tag{2}$$

Moreover, the pressure drop across orifice 70 ($\Delta P_{70}$) equals system pressure minus control chamber pressure, and the pressure drop across orifice 72 ($\Delta P_{72}$) equals chamber pressure minus inlet pressure. Inlet pressure can be assumed to be equal to zero, although it is normally a slight vacuum. Accordingly, equation (2) can be written as follows:

$$1 = \frac{A_{70}}{A_{72}}\sqrt{\frac{P_{(System)} - P_{(Control\ Chamber)}}{P_{(Control\ Chamber)}}} \quad \text{or} \tag{3}$$

$$1 = \frac{A_{70}}{A_{72}}\sqrt{\frac{P_{(System)}}{P_{(Control\ Chamber)}} - 1} \tag{4}$$

Equation (4) simplified is:

$$\frac{A_{72}}{A_{70}} = \sqrt{\frac{P_{(System)}}{P_{(Chamber)}} - 1} \tag{5}$$

$$\frac{A_{72}^2}{A_{70}^2} = \frac{P_{(System)}}{P_{(Chamber)}} - 1 \tag{6}$$

$$\frac{P_{(System)}}{P_{(Chamber)}} = \frac{A_{72}^2}{A_{70}^2} + 1 \tag{7}$$

Thus, equation (7) shows that the ratio of system pressure to chamber pressure is equal to the ratio of the squares of the areas of orifices 72 and 70 plus one.

Once the areas of the orifices 70, 72 are determined, the ratio of the squares of the areas will be a fixed proportion. Thereafter, the ratio of the system pressure, P(System), to chamber pressure, P(Chamber), will be a fixed proportion and will remain constant even though system pressure varies.

As noted above, the fluid pressure force acting on the cheek plate to move it away from the pump displacement mechanism 16 can be viewed as consisting of two components, A and B (FIG. 5). One force component, A, is due to system pressure, the other force component, B, is due to the pressure drop across the orifice 61. Viewed another way, the pressure acting on the surfaces 37*a*, 37*b* of the cheek plate 30 comprises system pressure (i.e., pressure in conduit 62) plus the pressure drop across orifice 61. Thus, force component A is the system pressure times the total area of surface portions 37*a*, 37*b*. Force component B is the pressure drop across orifice 61 times the total area of surface portions 37*a*, 37*b*. (In FIG. 5, the arrows representing force components A and B are not intended to show precise lines of action or magnitudes of the force components.)

Since the ratio of system pressure to chamber pressure is determined by the relative sizes of orifices 70, 72, this relationship can be used to balance the forces that act on the cheek plate. For example, if the total area of surface portions 37*a*, 37*b* is one fourth ($\frac{1}{4}$) the area of surface 36, the orifices 70, 72 can be sized to make system pressure four times chamber pressure. In such a case, the force component A due to system pressure acting on the cheek plate 30 would balance the force due to pressure in the cheek plate control chamber 35. Force component A would not balance the spring force, however.

The force component B acts on the cheek plate to oppose the spring force. The flow control orifice 61, as noted above, provides a pressure drop between pump outlet pressure and system pressure. The orifice is sized so that when the desired constant flow to the system is achieved, the pressure drop across the orifice 61 is of a magnitude to provide a force component B acting on the cheek plate which is equal to the spring force.

Figure 6:
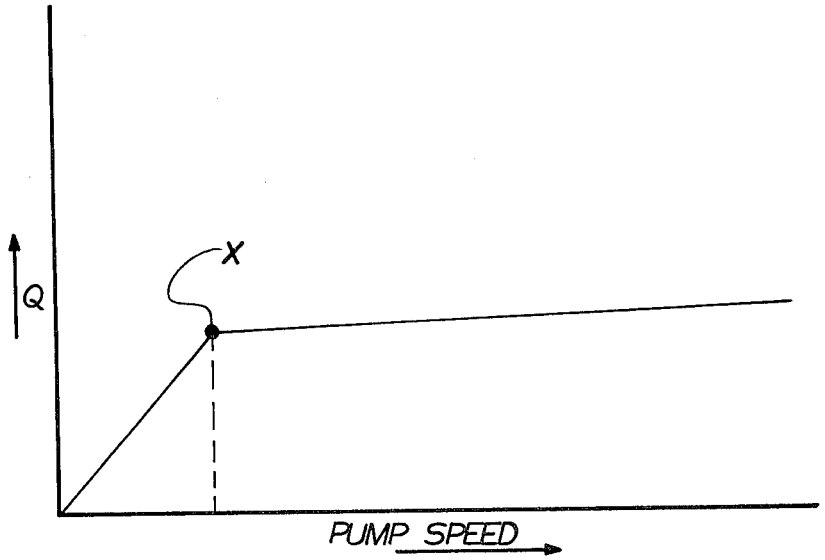
FIG. 6 is a graph showing operational characteristics of the pump of the present invention.

When the flow to the system increases beyond the desired flow, the pressure drop across orifice 61 will increase and the resulting increase in force component B will cause the cheek plate to move. As the cheek plate moves, the spring 31 will be compressed more and more. Although the amount of movement of the cheek plate is relatively small, the spring force will increase slightly. As a result, a larger pressure drop across orifice 61 will be necessary to effect a balance with the spring force. The graph of FIG. 6 shows, in an exaggerated manner, a slight increase in output flow as pump speed increases. This increase reflects the need for a higher pressure drop across the orifice 61 to effect balancing of the spring force as the spring is compressed.

During operation of the pump, a flow output is provided in accordance with the curve shown in FIG. 6. The curve shows that at zero pump speed, output from the pump is zero. As pump speed increases from zero, pump output increases at a linear rate to a point X on the curve. During this interval:

1. The pressure acting on surface portions 37*a*, 37*b* is progressively increasing;
2. The pressure acting on surface 36 in opposition to the pressure on surface portions 37*a*, 37*b* is also progressively increasing in a fixed relation to system pressure due to orifices 70, 72;
3. The spring 31 is acting on the cheek plate; and
4. The pressure drop through orifice 61 is increasing but is not sufficient to provide a force component B acting on the cheek plate equal to the preload of spring 31.

Thus, as the operating speed of the pump increases from zero to the operating speed corresponding to the point X on the curve of FIG. 6, the cheek plate remains in the sealing position of FIG. 4. When the pump operating speed reaches a speed corresponding to the point X on the curve of FIG. 6, the force component B is effective to balance the preload of the spring 31. In addition, the pressure in the cheek plate control chamber 35 multiplied by the area of the surface 36 is just equal to the system pressure multiplied by the total area of surface portions 37*a* and 37*b* (force component A). Therefore, when the pump reaches a speed corresponding to the point X on the curve of FIG. 6, the cheek plate 30 is in abutting engagement with the cam ring 20 (FIGS. 1 and 4) and the fluid pressure and spring forces on the cheek plate are balanced.

When the pump speed increases above the speed corresponding to the point X on the curve of FIG. 6, the flow through orifice 61 is instantaneously increased, which causes a finite increase in the pressure drop across orifice 61. Thus, the pressures on surface portions 37*a*, 37*b* instantaneously increase, which causes simultaneous unbalancing of the forces on the cheek plate. Specifically, the force component B will increase due to the increased pressure drop across orifice 61. The cheek plate will move to the right, away from the cam ring 20 and the position shown in FIGS. 1 and 4, so as to bypass fluid. Bypassing of fluid results in the rate of flow of fluid from the pump 10 decreasing to a flow rate substantially equal to the flow rate at the point X on the curve of FIG. 6. After transient pressure and flow conditions have stablized, the cheek plate 30 is balanced at one of an infinite number of bypass positions. At this time, the pump's speed and output pressure will be greater than the pump speed and output pressure at the point X on the curve of FIG. 6. Nonethless, because the cheek plate will be in a bypass position spaced a slight distance from the cam ring 20 so as to bypass fluid from the pump outlet ports to the pump inlet ports, fluid will be discharged from the pump 10 to the system at substantially the same flow rate as at the point X on the curve of FIG. 6.

In addition to responding to changes in pump speed, the cheek plate control system will respond to changes in system pressure. If system pressure increases, flow to the system will tend to decrease, and a finite decrease in the pressure drop across orifice 61 will occur. This will cause a decrease in force component B and an instantaneous unbalance of forces acting on the cheek plate 70. The cheek plate 70 will move to the left to bypass less fluid, and thus maintain the constant desired flow to the system. If system pressure decreases, flow to the system will tend to increase, and the pressure drop across the orifice 61 will increase. The force component B acting on the cheek plate will also tend to increase. As a result, the cheek plate will move to the right to bypass more fluid and thus to maintain flow to the system substantially constant.

From the above, it should be clear that the forces acting on the cheek plate are balanced when the pump output achieves the desired constant flow, i.e., at point X on the curve of FIG. 6. The force balancing is achieved through the orifices 61, 70, and 72. Orifices 70, 72 provide a continuous flow of pump outlet fluid from the system through the chamber 35 to the pump inlet. No servo valve is necessary for venting the pressure in the chamber 35 to control the cheek plate position.

For safety purposes, a relief valve 80 is provided in the cheek plate 30. The relief valve 80 is merely a spring biased ball valve which opens when a predetermined pressure is achieved in chamber 35. When the predetermined pressure is achieved and the valve 80 opens, pressure in chamber 35 is vented to the pump inlet. Of course, under these circumstances, maximum fluid flow is immediately bypassed from the system because the cheek plate moves to the right away from the pump components to an extreme position. It should be understood the relief valve is subject to the pressure in chamber 35, which is approximately one-fourth system pressure. Thus, the valve is subject to less leakage than if the valve encountered higher pressures.

The invention has been described above in detail. It should be obvious that changes and modifications can be made therein without departing from the scope of the invention.

What is claimed is:

1. Apparatus for providing fluid flow to a system, said apparatus comprising a housing partly defining a pumping chamber, pumping means in the pumping chamber, said pumping means having an inlet and an outlet, said pumping means being operable to pump fluid from said inlet to said outlet, a cheek plate defining with said housing said pumping chamber, said cheek plate having one side facing said pumping means, means defining a control chamber on the other side of said cheek plate, spring means biasing said cheek plate toward said pumping means and toward a position blocking flow of fluid from said outlet to said inlet across said one side of said cheek plate, said cheek plate being movable upon an unbalance of forces acting thereon, said forces comprising first and second fluid pressure forces and the spring biasing force provided by said spring means, said second fluid pressure force being provided by fluid pressure in said control chamber and acting with said spring biasing force on said other side of said cheek plate to bias said cheek plate into a position blocking said flow of fluid from said outlet to said inlet across said one side of said cheek plate, said first fluid pressure force acting on said one side of said cheek plate and against said second fluid pressure force and said spring biasing force, a first orifice directing flow from said outlet to the system, a second orifice located downstream of said first orifice and directing the flow from the system to said control chamber, and a third orifice directing flow from said control chamber to said inlet.

2. Apparatus as defined in claim 1 wherein said first and second fluid pressure forces act respectively on first and second surfaces respectively provided on said one side and said other side of said cheek plate, said first and second surfaces having respectively first and second total areas that are unequal, and wherein said second and third orifices are sized relative to each other so as to provide at a predetermined rate of fluid flow to the system a fluid pressure in said control chamber which has a ratio to pressure in the system generally equal to the ratio of said first area to said second area.

3. Apparatus as defined in claim 2 wherein said first fluid pressure force has two components, one component being dependent upon system pressure and the other component being dependent upon the pressure drop across said first orifice, said other component balancing said spring force when the forces on said cheek plate are balanced.

4. Apparatus as defined in claim 3 further including a pressure relief valve operable to vent the control chamber to the inlet, said pressure relief valve opening in response to the pressure in said control chamber reaching a predetermined level.

5. A pump for providing fluid flow to a system, said pump comprising a housing which partly defines a pumping chamber, pumping means in the pumping chamber, said pumping means having an inlet and outlet, said pumping means being operable to pump fluid from said inlet to said outlet, control means for maintaining a substantially constant flow of fluid to the system at pump speeds above a predetermined speed, said control means including a cheek plate defining with said housing said pumping chamber, said cheek plate having one side facing said pumping means and the other side facing a control chamber, spring means for biasing said cheek plate toward said pumping means and toward a position blocking said flow of fluid from said outlet to said inlet across said one side of said cheek plate, said cheek plate being movable upon an unbalance of forces acting thereon, said forces comprising first and second fluid pressure forces and the spring biasing force provided by said spring means, said second fluid pressure force being provided by fluid pressure in said control chamber and acting with said spring biasing force on said other side of said cheek plate to bias said cheek plate toward a position blocking flow of fluid from said outlet to said inlet across said one side of said cheek plate, said first fluid pressure force acting on said one side of said cheek plate and against said second fluid pressure force and said spring biasing force, and means for maintaining a continuous fluid flow from said system to said control chamber and from said control chamber to said inlet to effect balancing of said forces when said pump achieves said predetermined speed, said first and second fluid pressure forces acting respectively on first and second surfaces respectively provided on said one side and said other side of said cheek plate, said first and second surfaces having respectively first and second total areas that are unequal, and said means for maintaining a continuous fluid flow including orifices for directing fluid flow to and from said control chamber thereby providing a fluid pressure in said control chamber, the ratio of said fluid pressure in said control chamber to the pressure in the system at said predetermined pump speed being generally equal to the ratio of said second area to said first area.

6. A pump as defined in claim 1 further including a pressure relief valve, said pressure relief valve having a valve member which responds to the pressure in said control chamber.

7. A pump as defined in claim 5 further including a first orifice directing flow from said outlet to the system and wherein said orifices include a second orifice directing flow from the system to said control chamber and a third orifice directing a flow from said control chamber to said inlet.

8. A pump as defined in claim 1, wherein said first fluid pressure force has two components, one component being dependent upon system pressure and the other component being dependent upon the pressure drop across said first orifice, said other component balancing said spring force when the forces on said cheek plate are balanced.

* * * * *